US005485658A

United States Patent [19]

Fildan

[11] Patent Number: 5,485,658

[45] Date of Patent: Jan. 23, 1996

[54] GARMENT CLOSURE

[76] Inventor: Gerhard Fildan, Kriehburgergasse 31, A-1050 Vienna, Austria

[21] Appl. No.: 247,667

[22] Filed: May 23, 1994

[51] Int. Cl.[6] ..... A44B 11/00

[52] U.S. Cl. ..... 24/614; 24/630; 24/666

[58] Field of Search ..... 24/614, 583, 630, 24/666, 687; 450/36

[56] References Cited

U.S. PATENT DOCUMENTS

| | | | |
|---|---|---|---|
| 759,683 | 5/1904 | Dreisbach | 24/666 |
| 1,225,710 | 5/1917 | Herschede | 24/630 |
| 1,390,776 | 9/1921 | Gardner | 24/687 |
| 1,495,118 | 5/1924 | Starck | 24/630 |
| 3,513,852 | 5/1970 | Seidl | 450/36 |
| 4,204,300 | 5/1980 | Fildan | 24/630 |
| 4,335,728 | 6/1982 | Fildan | 450/36 |
| 5,033,171 | 7/1991 | Kasai | 24/614 |

FOREIGN PATENT DOCUMENTS

| | | | |
|---|---|---|---|
| 0002501 | 4/1891 | United Kingdom | 24/630 |

*Primary Examiner*—Victor N. Sakran
*Attorney, Agent, or Firm*—Herbert Dubno

[57] ABSTRACT

A hook-type closure has a stirrup on a plate member which fits in a window of an eye member and passes over a tongue projecting into the window and flanked by a pair of detents past which the stirrup is forced and which retain the stirrup against inadvertent release from the tongue.

8 Claims, 5 Drawing Sheets

GARMENT CLOSURE

FIELD OF THE INVENTION

My present invention relates to a garment closure and, more particularly, to a closure for maternity brassieres and, in general, for opposite portions of a garment, especially an undergarment, utilizing a tongue and stirrup configuration of the mutually-engaging members.

BACKGROUND OF THE INVENTION

In my U.S. Pat. No. 4,204,300, I have described a hook fastener for garments in which the two members to be interconnected by the hook action, connected to two parts of a garment to be so connected, include a stirrup or bridge structure and a tongue or lug structure which operate by insertion of the stirrup in a window into which the tongue extends so that tension can then pull the stirrup over the tongue or the tongue into the stirrup. The two members are generally flat and the tongue lies in the plane of one member while the stirrup projects from the plane of the other.

Mention may also be made of the maternity nursing brassiere fastener described in U.S. Pat. No. 4,335,728 in which another hook utilizing an eye or window in one of the strap links is provided.

In an application of such closure for a nursing brassiere, one of the members of the closure is a link between a support strap and the cup-forming member of the brassiere while the other member of the fastener is attached to a flap which covers the nursing breast when the fastener is secured, but which exposes the nursing nipple when the fastener is unhooked.

Such closures also may be used on opposite edges of an undergarment, for example the rear or front closures of a brassiere and can be stitched along edges of the fabric garment which are to be held together by the fastener.

While these earlier fasteners have proved to be highly effective in use and are in widespread use today, improvement has been found to be desirable.

OBJECTS OF THE INVENTION

It is, therefore, the principal object of the present invention to provide an improved garment closure, especially for a nursing brassiere, which enables the user to more readily release and engage the closure for nursing purposes, thereby reducing the delay with which an infant may have access to nursing.

Yet another object of the invention is to provide an improved garment closure for the purposes described which is easier to attach to the garment and which has improved comfort for the wearer.

Still another object of the invention is to provide an improved garment closure which has all of the advantages of the closures described and yet is faster-acting and more convenient to manipulate.

SUMMARY OF THE INVENTION

These objects are achieved, in accordance with the invention, in a garment closure of the type in which a transversely-projecting stirrup can be engaged over a tongue extending into a window as has been described previously, but where the bar structure, e.g. for attachment to the flap of the brassiere which is released to afford access to the nursing nipple, is angled to the plate of that closure member, to thereby facilitate engagement or disengagement of the closure.

The angle, which can be between 10° and 20° and preferably is 15° (i.e. 15°±5°) also allows the strap more naturally to follow the contour of the breast and thereby provides increased comfort to the wearer.

A closure for a maternity brassiere, according to invention thus can provide:

a flat link lying in a plane and having an upper bar engageable by a brassiere support strap, a lower bar connectable to a breast cup of the brassiere by a fabric loop, a window formed in the link between the bars, and a wedge-shaped tongue projecting into the window; and a connecting member releasably engageable with the flat link and having a plate dimensioned substantially to cover the window and the tongue when the connecting member is engaged with the link, a stirrup formed on an inner surface of the plate, engageable in the window and receiving the tongue, and a planar extension connected to the plate and inclined thereto, the extension being formed with a bar connectable to a loop of a brassiere flap covering an opening in the cup through which a nipple of a wearer can be exposed upon disengagement of the stirrup from the tongue.

Advantageously, the plate has the configuration of a shield.

The tongue can be disposed between a pair of flanks spaced from the tongue to receive opposite sides of the stirrup between the tongue and the flanks. The flanks can be formed with inwardly-extending detents limiting inadvertent slippage of the stirrup from the tongue.

The lower bar, in the configuration described, can have a downwardly tapered cross section to allow the loop of the strap engaged over the bar to be stitched closer to the bar than has hitherto been possible.

According to another feature of the invention, the bar of the connecting member is disposed opposite a convex portion of the plate defining a narrow gap with the bar of the connecting member to reduce play of a loop passing through this gap. Of course, in small sizes of the closure and of the strap, where such reduction of play is not necessary, this convex portion of the plate can be eliminated.

The upper bar may itself delimit the window or can be spaced from the window by a gap from an intermediate bar which delimits the window. The stirrup can have opposite mutually-converging sides facilitating its insertion past the detents.

The plate can have the outer side molded with a decorative pattern, for example, an embossed configuration of a nursing mother.

A principle of the invention is also applicable to a construction of the closure according to another aspect of the invention in which the stirrup and tongue assembly are provided in a chain on respective strips which can be stitched to the opposite edges of the garment.

In this case as well, the stirrup can be shifted onto the tongue by the application of tension after insertion of the stirrup in the window, projections forming detents analogous to those described above.

The garment closure can then comprise:

a first flexible strip of a plastic adapted to be stitched along one edge of a fabric garment and formed with a plurality of first link members interconnected in a chain by flexible webs, each of the first link members including a base connected by at least one of the webs to a base of an adjoining first link member whereby the chain can flex at the webs, a generally trapezoidal eye projecting laterally from the base and forming a frame around a respective window, a tongue projecting from a limb of the frame into the window toward the respective base, and respective projections on three other limbs of the frame into the window; and a second flexible plastic strip adapted to be sewn onto another edge of the fabric garment for engagement with and disengagement from the first flexible strip, the second flexible strip comprising a plurality of second link members interconnected in a chain by respective flexible webs, the second link members each having a base connected by at least one of the webs of the second strip to a web of another second link member, a generally trapezoidal formation extending from the respective base of the second link member and coplanar with the respective base, and a respective stirrup projecting from a face of the respective trapezoidal formation, dimensioned to fit into a respective one of the windows through a gap between the tongue and projections thereof with deflection of the tongue and projections, and receiving the tongue upon application of tension to the strips.

The first and second strips can each be provided with throughgoing slots between the trapezoidal eye or trapezoidal formation and the respective base. Each of the formations can have a rectangular hole aligned with the respective stirrup.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
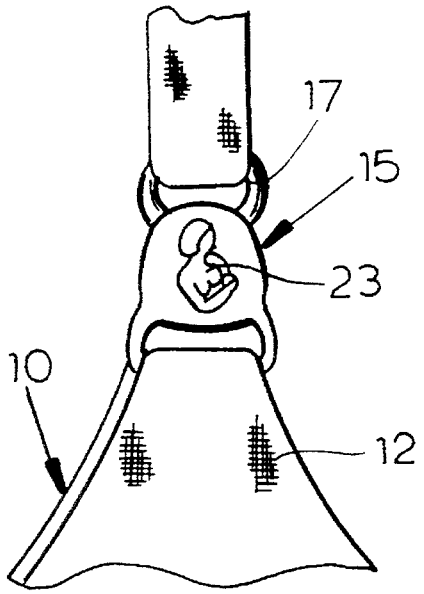
FIG. 5 is a diagrammatic elevational view showing the closure in place and the flap of the brassier closed.
Figure 6:
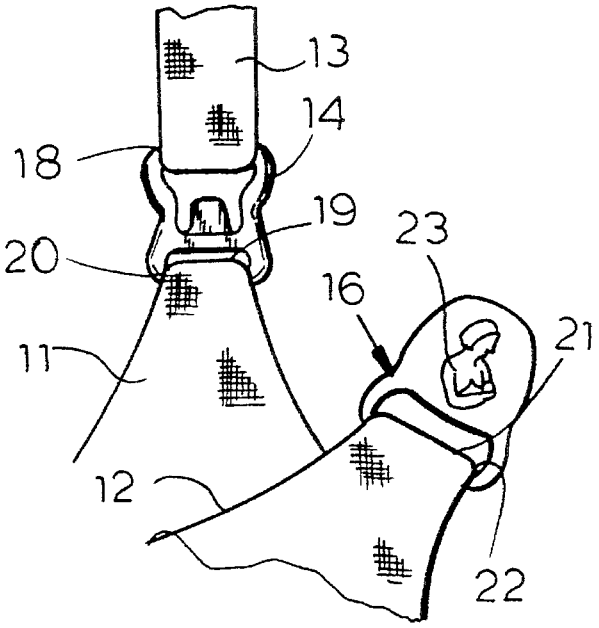
FIG. 6 is a view similar to FIG. 5 but illustrating the release of the flap to expose the nipple for nursing.

Referring first to FIGS. 5 and 6, it can be seen that a maternity nursing brassiere 10 can have a support 11 formed with a cup having an opening normally covered by a flap 12, the flap being released to expose the nipple of the wearer for nursing.

The support 11 is suspended from two straps, one of which can be seen at 13, connected to the support 11 by a link 14 forming one part of a closure 15. The other part of the closure 15 is a member 16 which is connected to the member 14 by a stirrup and tongue connection system to be described in greater detail below. The strap 13 is formed with a loop 17 passing around an upper bar 18 of the link 14 while the support 11 has a loop 19 passing around a lower bar 20 of the link. A loop 21 of the flap 12 passes around a bar 22 of member 21 which is formed in relief during the injection molding process with a decorative pattern 23, e.g. of a woman nursing.

In use, the nipple is normally covered (FIG. 5), as is necessary, the nipple is uncovered by release of member 16 (FIG. 6) to allow nursing through the opening in the support portion 11 of the brassiere.

From FIGS. 1–4, it will be apparent that the link member 14 of the fastener 15 comprises, in addition to the upper bar 17, and the lower bar 20, a trapezoidal frame 24 delimiting a window 25 which is also of generally trapezoidal configuration and into which projects a tongue 26 from a bar portion 27 separated by an oval passage 28 from the lower bar 20. The tongue 26 is spaced from flanks 29 and 30 of the window, these flanks having inwardly projecting detents 31 and 32 which narrow the clearance 33 between the flanks and the tongue 26.

Figure 2:
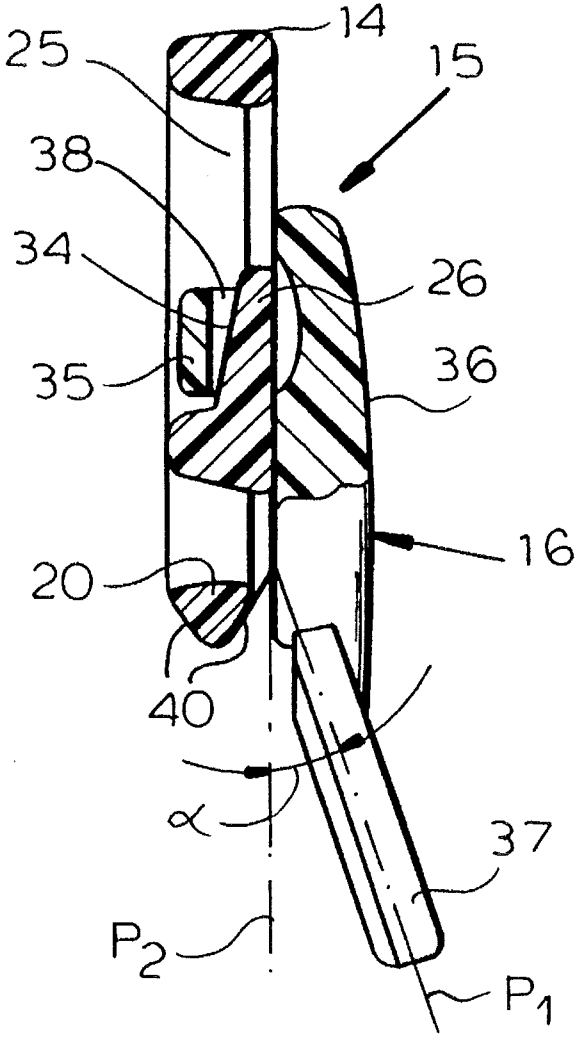
FIG. 2 is a cross sectional view through this fastener.

As can be seen from FIG. 2, the tongue 26 has a tapered surface 34 facilitating the passage of a stirrup 35 over the tongue and providing a wedging action which draws plate 36 of member 16 tightly against the member 14.

The plate 36 has the configuration of a shield (see FIG. 1) and is provided with the embossed pattern 23 as shown only in FIGS. 5 and 6. The plane of the plate 36 is generally parallel to the plane of member 14 and the bar 22 of the member 16 lies in a plane $P_1$ which is inclined to the plane $P_2$ at an angle $\alpha$ of $15°\pm5°$. The angle approximates the slope of the upper part of the breast so that the loop segment 37 integral with the plate 36 and formed with the bar 22, i.e. the means for attaching member 16 to the flap 12, will not press against the breast of the wearer.

Figure 1:
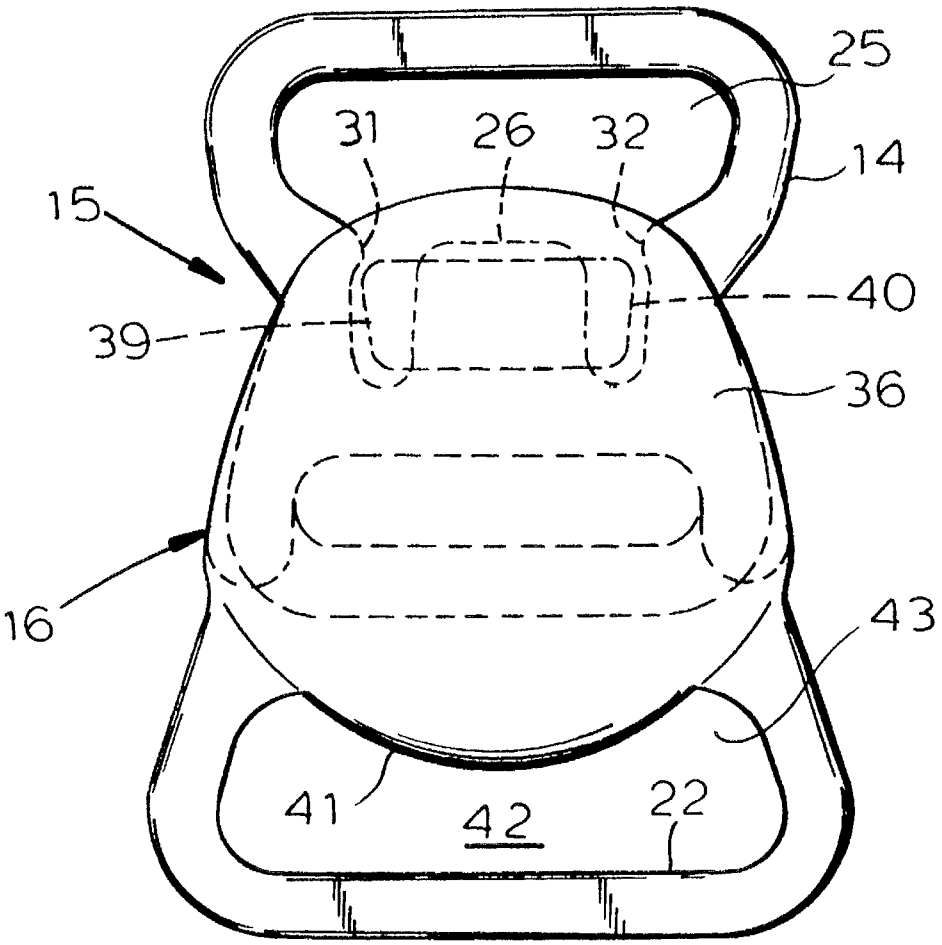
FIG. 1 is an elevational view of a maternity brassiere closure or fastener in accordance with a first aspect of the invention.
Figure 4:
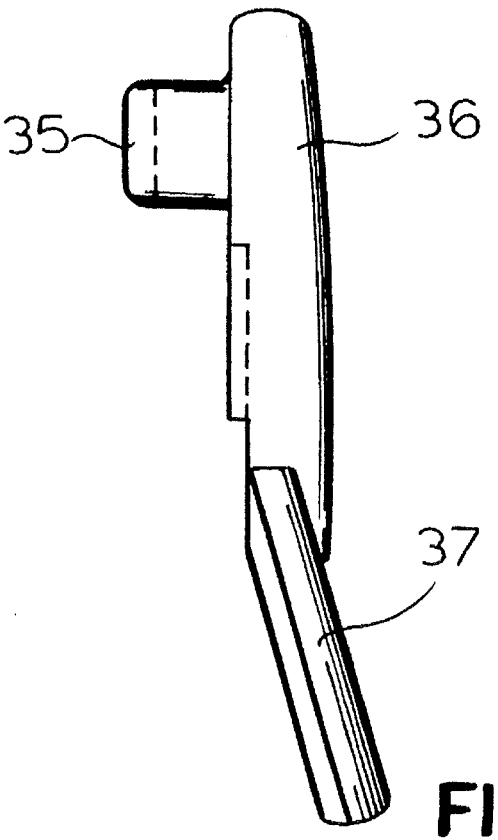
FIG. 4 is a side view of the flap member of the closure.
Figure 3:
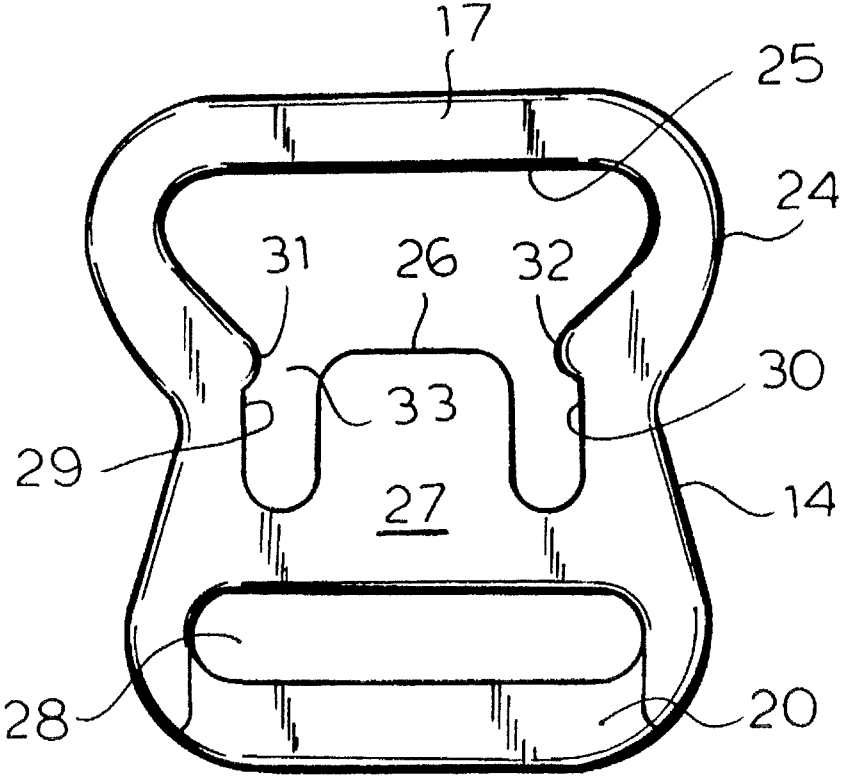
FIG. 3 an elevational view of the link member of this fastener

The stirrup 35 has an opening or passage 38 allowing it to be fitted over the tongue 26 and a pair of flanks 39 and 40 which converge downwardly in FIG. 1 so as to facilitate passage of the stirrup past the detents 31 and 32. The detents 31 and 32 retain the stirrup on the tongue until member 16 is forced upwardly (FIGS. 1 and 2) past the detents to release the closure.

The inclined configuration of loop 37 facilitates reinsertion of the detent into the window 25 when the user wishes to hook the stirrup 35 again onto the tongue 26.

As can be seen from FIG. 2, moreover, the lower bar 20 of the link 14 has downwardly converging flanks 40 to allow the loop 20 to be stitched close to the bar 20. Furthermore, the shield 36 can be formed at its lower end with a rounded or convex portion 41 narrowing the gap 42 with the bar 22 and thereby reducing play for a strap received in the clearance 43 between the bar 22 and the plate 36.

Figure 14:
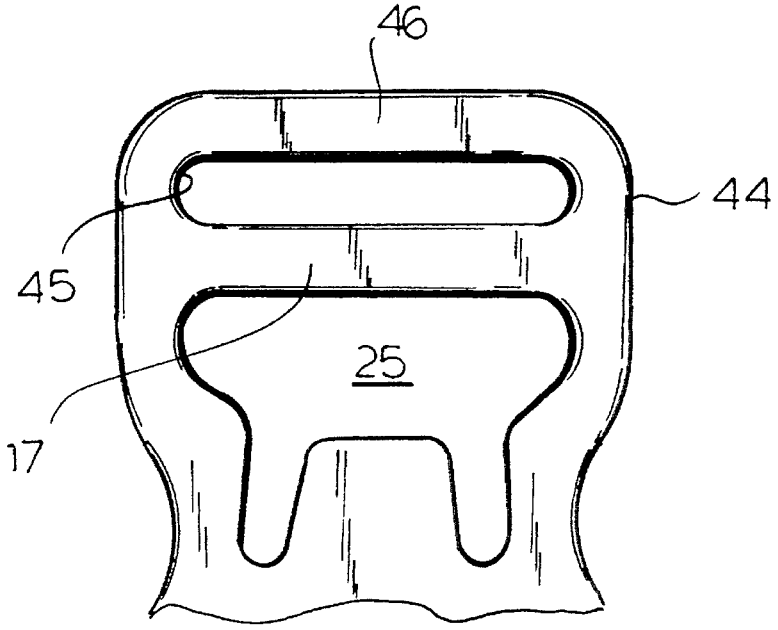
FIG. 14 is a view of a portion of the link member of the closure of FIGS. 1–6, modified to include an additional bar for a brassiere support strap.
Figure 10:
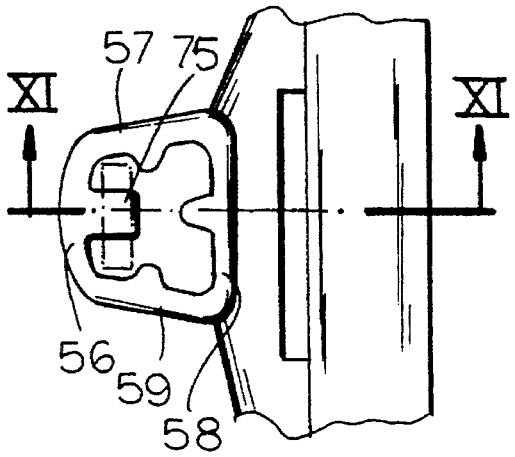
FIG. 10 is a detail view of the member of the closure provided with the windows.
Figure 12:
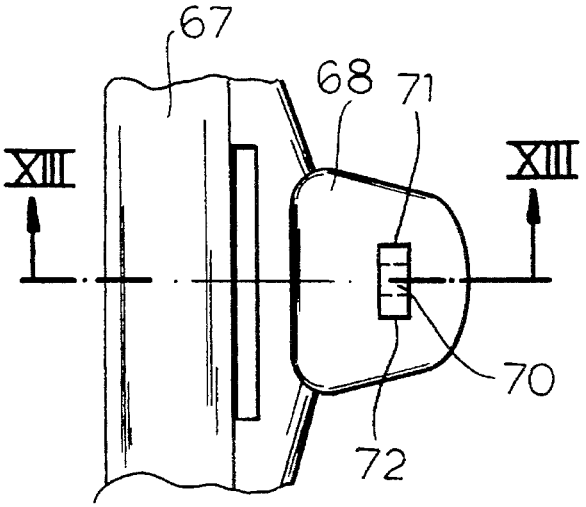
FIG. 12 is a detail view of a section of the closure provided with the stirrup.
Figure 11:
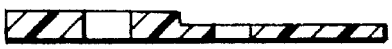
FIG. 11 is a section along the line XI—XI of FIG. 10.
Figure 13:
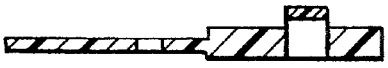
FIG. 13 is a section along the line XIII—XIII.

FIG. 14 shows at 44 modification of the link 14 wherein, however, the window 25 is delimited by an intermediate bar 17 forming a gap 45 with an upper bar 46 engaged by the loop of the brassiere strap 13.

FIGS. 7–13 illustrate another embodiment of the invention utilizing a similar principle. As can be seen from FIG. 7–9, this closure comprises a first strip 50 and a second strip 51, each formed by molding, stamping or the like from thin synthetic resin material, i.e. a plastic, so that the strips can flex perpendicular to the plane thereof which corresponds to the plane of the paper in FIGS. 7–9. More particularly, the first strip 50 comprises five first link members 52, each of which has a base 53 connected by at least one thin web 54 with an adjoining link in a chain thereof.

The webs provide flexure in a direction perpendicular to the plane of the paper. The links 52 also have eyes 55 formed by trapezoidal frame limbs 56, 57, 58 and 59 surrounding window 60 which is also of generally trapezoidal configuration.

From the limb 56 a tongue 75 projects into the window and toward the respective base 53, the tongue being analogous to the tongue 26 of the embodiment previously described. A pair of projections 61 and 62 on the limbs 57 and 59 flanking the tongue 75 provide detents past which a stirrup can be pressed to retain the stirrup on the tongue once the stirrup is inserted into the window perpendicular to the plane thereof. A further projection 63 on the limb 58 provides an additional deterrent to the stirrup from slipping off the tongue inadvertently although the stirrup can be pressed into the window past the detents which are pulled out of the window to release the fastener.

The strip 50 also is formed with slots 65 between the eyes and the bases and through which the strip 50 can be sewn onto one edge of a fabric garment to be connected by the fastener to another edge.

That other edge also has sewn onto the strip 51 which is formed with a similar chain of second links 66 each of which has a base 67 connected by at least one web 68 to the base of an adjoining web.

In this case, however, each base 67 has a trapezoidal formation 68 integral therewith and a throughgoing slot 69 disposed between the base and the formation. Each of the formations 68 is provided with an upstanding stirrup 70 engageable in the window of a link of the first strip 50 and adapted to be drawn past the detents thereof onto the respective tongue.

FIGS. 10–13 show the configurations of these links in greater detail.

The flanks 71 and 72 of the stirrup 70 can converge in the direction in which the stirrup is drawn over the tongue to facilitate passage of the detents 61 and 62 thereby.

Figure 9:
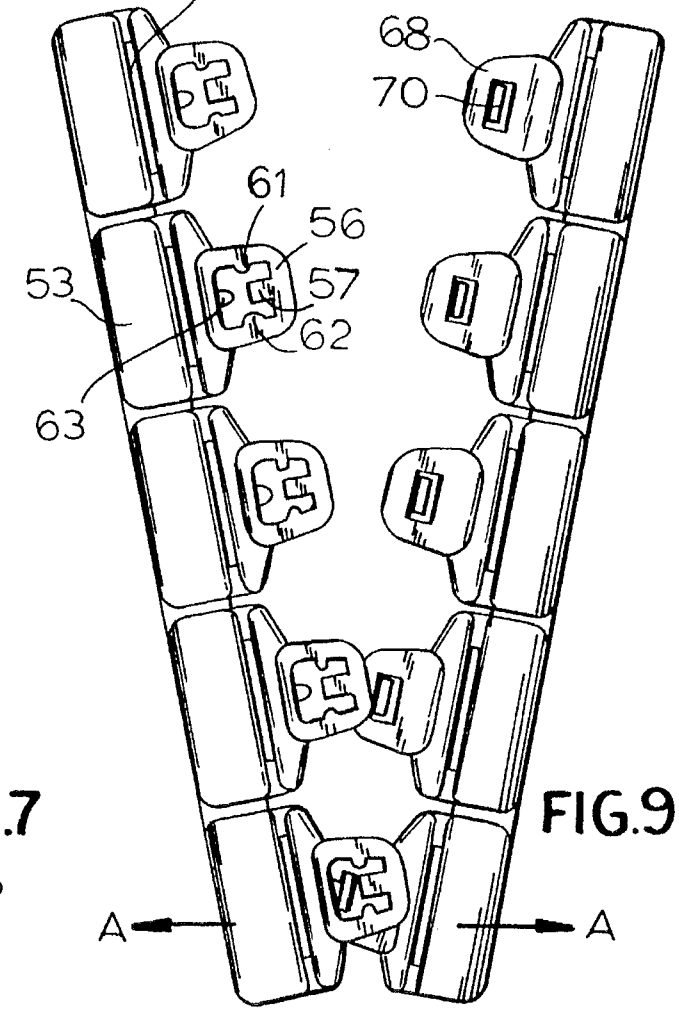
FIG. 9 is an elevational view showing the latter closure partly disengaged.
Figure 7:
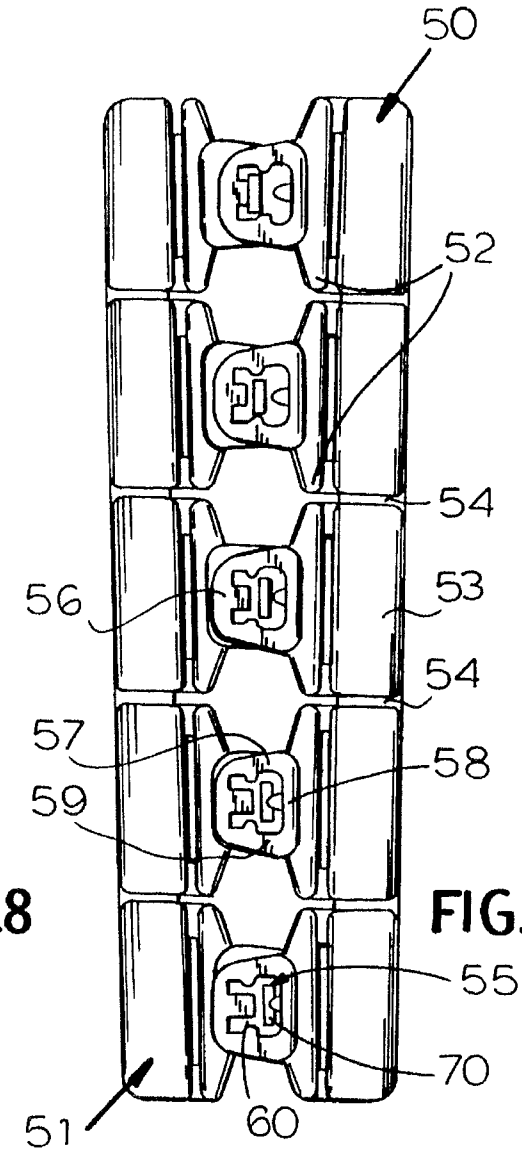
FIG. 7 is an elevational view of a second embodiment of a garment closure according to the invention.
Figure 8:
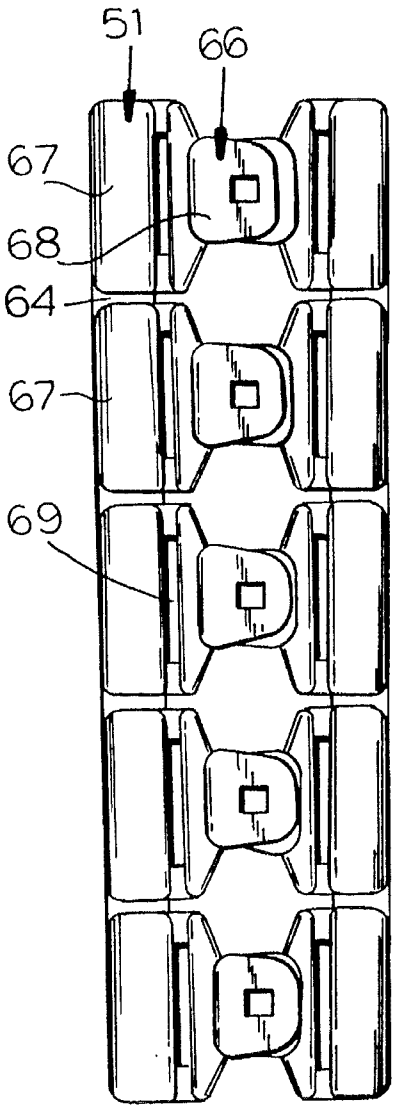
FIG. 8 is a view similar to FIG. 7 of the garment closure from the opposite side.

In operation, the detents 70 are inserted into the windows of the strip 50 in succession and are then drawn over the tongues by a pull in the direction of the arrows A in FIG. 9, thereby forcing the stirrups 70 to clear the detents 61 and 62, thereby locking the closure in the closed position. For opening, the two strips are pressed together to allow the tongues to clear the stirrups and the stirrups are then pulled out of the windows in a direction perpendicular to the planes of the strips.

I claim:

1. A closure for a maternity brassiere, comprising:

a flat link lying in a plane and having an upper bar engageable by a brassiere support strap, a lower bar connectable to a breast cup of the brassiere by a fabric loop, a window formed in said link between said bars, and a wedge-shaped tongue projecting into said window; and a connecting member releasably engageable with said flat link and having a plate dimensioned substantially to cover said window and said tongue when said connecting member is engaged with said link, a stirrup formed on an inner surface of said plate, engageable in said window and receiving said tongue, and a planar extension connected to said plate and inclined thereto, said extension being formed with a bar connectable to a loop of a brassiere flap covering an opening in said cup through which a nipple of a wearer can be exposed upon disengagement of said stirrup from said tongue, said plate has a configuration of a shield, said tongue being disposed between a pair of flanks spaced from the tongue to receive opposite sides of said stirrup between said tongue and said flanks, said flanks being formed with inwardly extending detents limiting inadvertent slippage of said stirrup from said tongue.

2. The closure defined in claim 1 wherein a plane of said extension includes an angle of 15°±5° with said plate and a plane of said link.

3. The closure defined in claim 2 wherein said lower bar has a downwardly tapered cross section.

4. The closure defined in claim 3 wherein said bar of said connecting member is disposed opposite a convex portion of said plate defining a narrow gap with said bar of said connecting member to reduce play of a loop passing through said gap.

5. The closure defined in claim 4 wherein said link has an intermediate bar delimiting said window and spaced from said upper bar.

6. The closure defined in claim 4 wherein said upper bar delimits said window.

7. The closure defined in claim 4 wherein said stirrup has opposite mutually converging sides.

8. The closure defined in claim 4 wherein said plate has an outer side formed with a molded decorative pattern.

* * * * *